US007507972B2

(12) United States Patent
Rush et al.

(10) Patent No.: US 7,507,972 B2
(45) Date of Patent: Mar. 24, 2009

(54) COMPACT IONIZATION SOURCE

(75) Inventors: Martyn Rush, Cambridge (GB); Paul Boyle, London (GB); David Ruiz-Alonso, Cambridge (GB); Andrew Koehl, Cambridge (GB); Russell Parris, Cambridge (GB); Ashley Wilks, Cambridge (GB)

(73) Assignee: Owlstone Nanotech, Inc., New York, NY (US)

( * ) Notice: Subject to any disclaimer, the term of this patent is extended or adjusted under 35 U.S.C. 154(b) by 189 days.

(21) Appl. No.: 11/247,016

(22) Filed: Oct. 10, 2005

(65) Prior Publication Data

US 2007/0080304 A1 Apr. 12, 2007

(51) Int. Cl.
*H01J 27/00* (2006.01)

(52) U.S. Cl. ..... 250/423 R; 250/423 F

(58) Field of Classification Search ... 250/423 R–423 F
See application file for complete search history.

(56) References Cited

U.S. PATENT DOCUMENTS 3,665,241 A 5/1972 Spindt et al.
5,252,833 A * 10/1993 Kane et al. ..... 250/423 F
6,031,239 A * 2/2000 Shi et al. ..... 250/492.21
6,225,623 B1 5/2001 Turner et al.
6,882,094 B2 4/2005 Dimitrijevic
6,885,010 B1 4/2005 Traynor et al.
6,958,134 B2 * 10/2005 Taylor et al. ..... 422/186.04
6,974,646 B2 * 12/2005 Noetzel et al. ..... 429/34
2003/0070913 A1 4/2003 Miller et al.
2005/0141999 A1 * 6/2005 Bonne ..... 417/48

OTHER PUBLICATIONS

M. Chhowalla et al., "Growth process conditions of vertically aligned carbon nanotubes using plasma enhanced chemical vapor deposition," J. Appl. Phys., vol. 90, No. 10, pp. 5308-5317, (Nov. 15, 2001).
B.S. Satyanarayana et al., "Field emission from tetrahedral amorphous carbon," Appl. Phys. Lett., 71(10), 11430-1432, (Sep. 8, 1997).

* cited by examiner

*Primary Examiner*—Jack I Berman
*Assistant Examiner*—Andrew Smyth
(74) *Attorney, Agent, or Firm*—Morgan, Lewis & Bockius LLP

(57) ABSTRACT

A compact ionization source includes first and second electrodes, each having a plurality of fingers that are interdigitated with each other. The spacing between the first and second electrode, preferably less than 1 mm, creates a large electric field when a potential is applied across the first and second electrodes. The large electric field creates an ionization volume between the fingers of the first and second electrode and ionizes a portion of the molecules occupying the ionization volume. The interdigitated fingers of the first and second electrodes allow for a narrow gap separating the electrodes while presenting a large flow area for ionizing molecules for downstream analysis.

18 Claims, 5 Drawing Sheets

COMPACT IONIZATION SOURCE

BACKGROUND OF THE INVENTION

1. Field of the Invention

The present invention relates to devices and methods for generating ions. More specifically, the invention relates to compact devices and methods for generating ions using a corona discharge at or near atmospheric pressure.

2. Description of the Related Art

Radioactive isotopes such as $^{241}$Am or $^{63}$Ni are commonly used as ionization sources to generate ions in a surrounding gas stream. Radioactive ionization sources have the advantage of simplicity, compactness, durability, and reliability. The regulations associated with these radioactive ionization sources, however, may render the incorporation of radioactive isotopes into a product economically unfeasible.

Electric field ionization has the advantage of simple design, relatively simple fabrication, and low power consumption. In electric field ionization, a large electric field between $10^7$ to $10^8$ V/m is generated between two electrodes. The large electric field accelerates any ions within the field thereby causing the accelerated ions to collide with surrounding gas molecules. The collision of an accelerated ion and a gas molecule creates an ionized molecule.

A corona discharge is a type of electric field ionization where a neutral fluid such as, for example, air is ionized near an electrode having a high electric potential gradient. Such a potential gradient is achieved by using a discharge electrode, having a small radius of curvature. The polarity of the discharge electrode determines whether the corona is a positive or negative corona. The corona has a plasma region and a unipolar region. In the plasma region, electrons avalanche to create more electron/ion pairs. In the unipolar region, the slowly moving massive (relative to the electron mass) ions move to the passive electrode, which is usually grounded. If the plasma region grows to encompass the passive electrode, a momentary spark or a continuous arc may occur. The spark or arc may damage the electrodes, produce contaminant ions, and reduce the lifetime of the ionization source. Therefore, there remains a need for devices and methods for compact ionization sources with longer lifetimes.

SUMMARY OF THE INVENTION

A compact ionization source includes first and second electrodes, each having a plurality of fingers that are interdigitated with each other. The spacing between the first and second electrodes, preferably less than 1 mm, creates a large electric field when a potential is applied across the first and second electrodes. The large electric field creates an ionization volume between the fingers of the first and second electrodes and ionizes a portion of the molecules occupying the ionization volume. The interdigitated fingers of the first and second electrodes allow for a narrow gap separating the electrodes while presenting a large flow area for ionizing molecules for downstream analysis.

One embodiment of the present invention is directed to an ionization source comprising: a first electrode having a first plurality of fingers; a second electrode having a second plurality of fingers, the first plurality of fingers being disposed between the second plurality of fingers; and a generator for applying a signal between the first and second electrodes, the signal generating an ionization volume between the first and second electrodes. In some aspects of the present invention, a distance between the first electrode and the second electrode is between 100 μm and 1 μm, preferably 60 μm and 5 μm and most preferably between 40 μm and 10 μm. In some aspects of the present invention, the ionization source further comprises a carbon nanotube layer disposed on a side of the first electrode facing a side of the second electrode. In some aspects of the present invention, the carbon nanotube layer comprises a plurality of carbon nanotubes characterized by a longitudinal axis, the longitudinal axis parallel to a surface normal of the side of the first electrode. In some aspects of the present invention, the ionization source further comprises a diamond-like coating (DLC) layer deposited on the first and second electrodes. In some aspects of the present invention, the DLC layer is comprised of tetrahedral amorphous carbon (ta-C). In some aspects of the present invention, the ta-C is n-doped.

BRIEF DESCRIPTION OF THE DRAWINGS

The invention will be described by reference to the preferred and alternative embodiments thereof in conjunction with the drawings in which.

DETAILED DESCRIPTION

Figure 1:
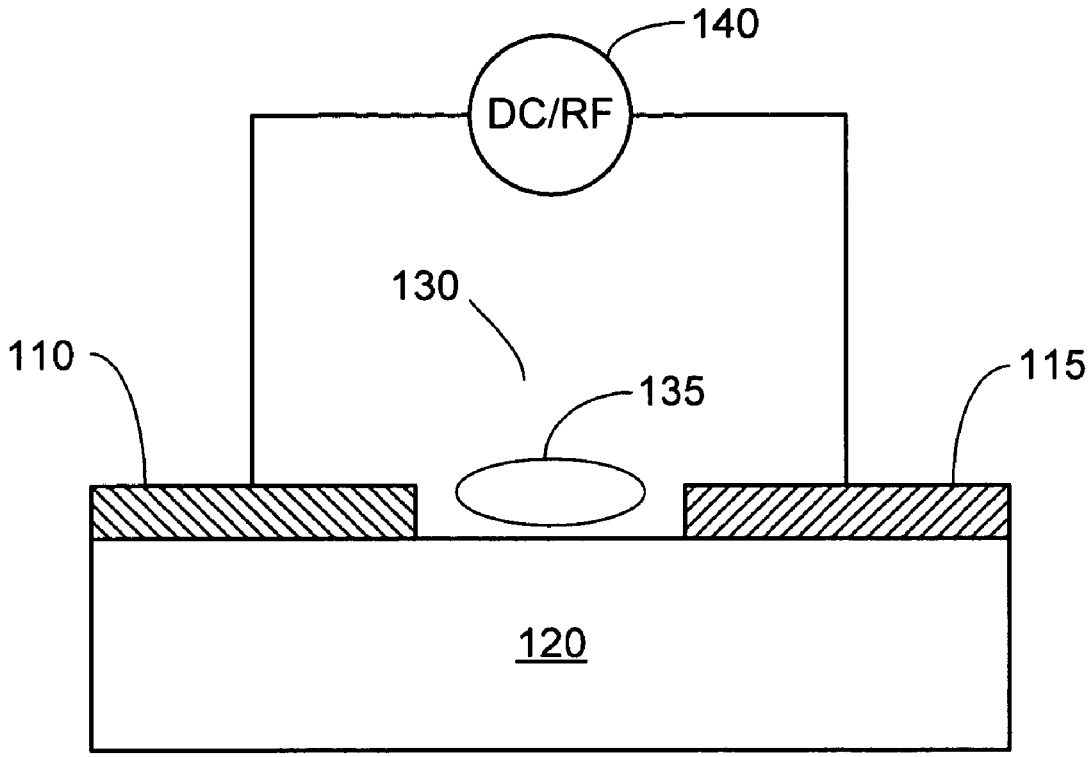
FIG. 1 is a side view of an embodiment of the present invention.

FIG. 1 is a side view of an embodiment of the present invention. In FIG. 1, a first electrode 110 and a second electrode 115 are disposed on a substrate 120 and separated by a gap 130. A DC or RF signal 140 is applied between the first and second electrodes. A DC, pulsed DC, or radio frequency signal may be applied between the first and second electrodes using commonly known methods for generating the applied signal. The electric field generated by signal 140 creates an ionized volume 135 in the gap 130 between the first and second electrodes.

The configuration shown in FIG. 1 may be fabricated using well-known microelectronic processing methods. The electrodes may be Pt, Au, Cr, Cu, Ni, or other suitable electrode materials that may be sputtered, chemical vapor deposited or electroplated onto the substrate. The substrate is preferably silicon but may also be selected from insulator materials known in the microelectronic process arts.

Figure 2:
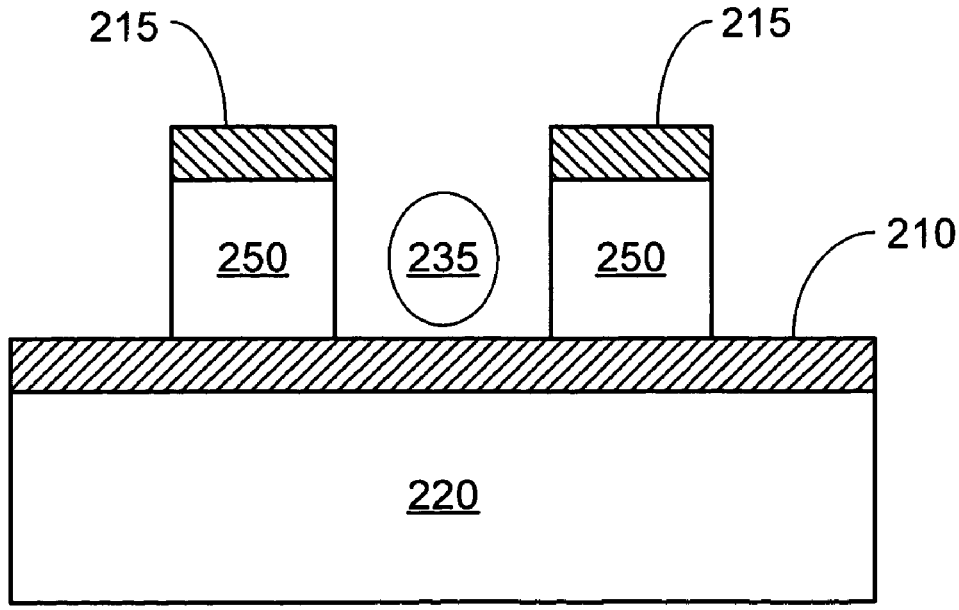
FIG. 2 is a side view of another embodiment of the present invention.

FIG. 2 is a side view of another embodiment of the present invention. In FIG. 2, a first electrode 210 is deposited on a substrate 220. An insulator 250 is disposed on a portion of the first electrode 210 and a second electrode 215 is disposed on the insulator 250. A voltage potential, not shown, is applied between the first and second electrode and creates an ionized volume 235 between the first and second electrodes. The embodiment shown in FIG. 2 may be fabricated using any of the microelectronic processing methods known in the microelectronic processing arts. The electrodes may be Pt, Au, Cr, Cu, Ni, or other suitable electrode materials that may be sputtered, chemical vapor deposited or electroplated onto the substrate. The insulator is preferably silicon but may also be selected from insulator materials known in the microelectronic process arts. Similarly, the substrate is preferably silicon but may also be selected from insulator materials known in the microelectronic process arts.

Figure 3:
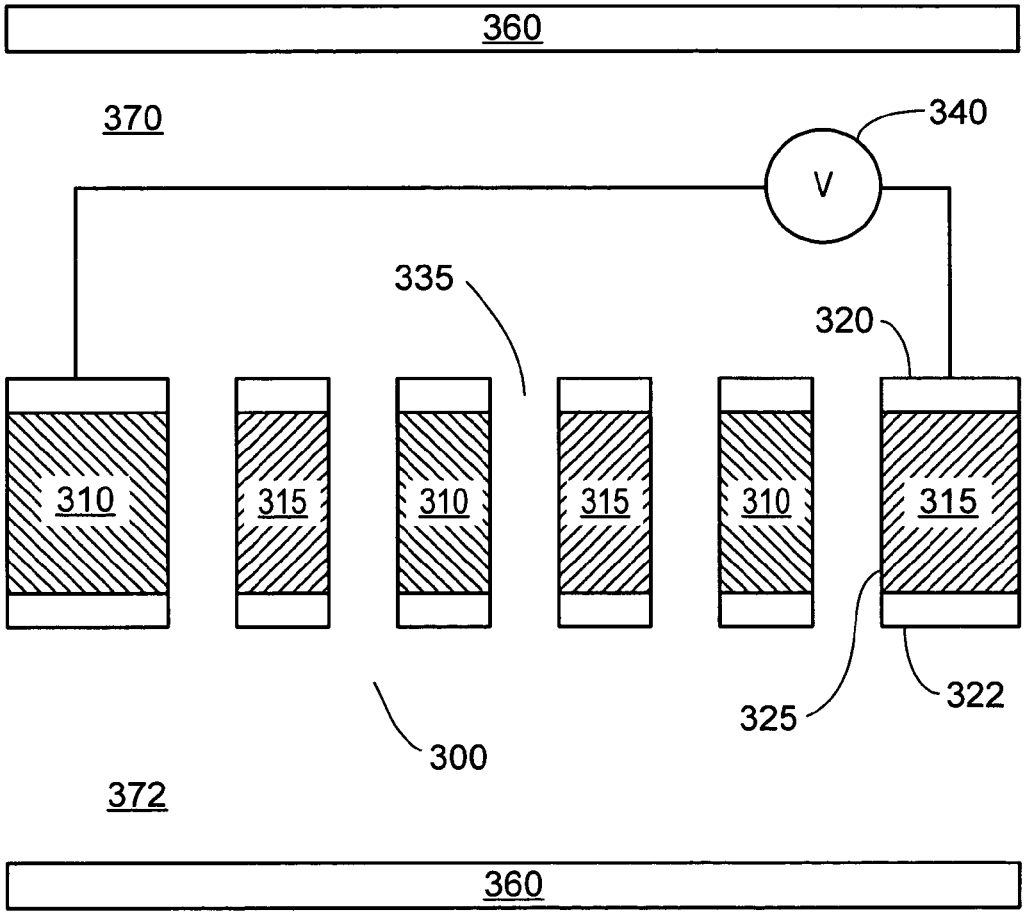
FIG. 3 is a side view of another embodiment of the present invention.

FIG. 3 is a side view of another embodiment of the present invention. In FIG. 3, ionizer 300 includes a first electrode 310 and a second electrode 315. Each electrode 310, 315 is preferably comb shaped, when seen from above, with the fingers of one electrode interdigitated with the fingers of the other electrode such that each finger of the first electrode is between fingers of the second electrode. The first and second electrodes are spaced apart such that the gaps between neighboring fingers define channels having a volume 335 where molecules may be ionized. The distance between neighboring fingers is preferably between 1-100 μm, more preferably between 5-60 μm, and most preferably between 10-40 μm.

Figure 6:
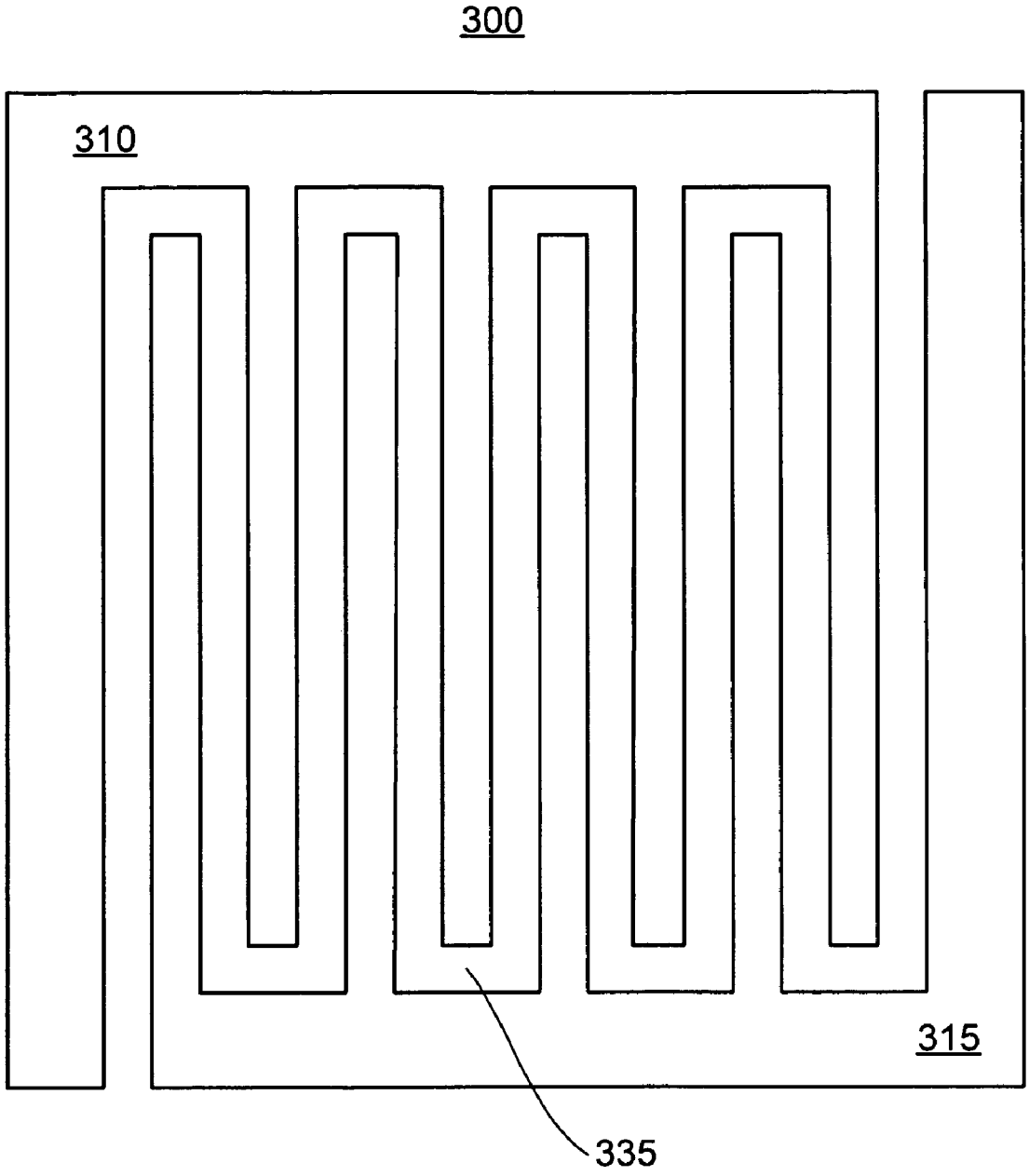
FIG. 6 is a top view of the embodiment shown in FIG. 3.

FIG. 6 is a top view of the embodiment shown in FIG. 3. In FIG. 6, structures identical to structures in FIG. 3 are referenced with the corresponding reference number in FIG. 3. FIG. 6 shows the comb shaped first and second electrodes with interdigitated fingers. In FIG. 6, each electrode is shown with five fingers for purposes of clarity but it should be understood that electrodes with more than one finger are within the scope of the present invention. FIG. 6 also illustrates that the gap between the first and second electrodes forms a continuous serpentine channel with a small channel width. The length of the channel may be controlled by the number of fingers in the first and second electrode. Increasing the length of the channel by increasing the number of fingers in the first and second electrodes increases the flow area through the ionizer. Thus, the interdigitated electrodes creates a volume with a large flow area while maintaining a narrow gap.

Each electrode 310, 315 includes a metal layer 320 deposited on substrate 325. The metal layers 320 may be Pt, Au, Cr, Cu, Ni, or other suitable electrode materials that may be sputtered, chemical vapor deposited or electroplated onto the substrate. The substrate is preferably silicon but may also be selected from insulator materials known in the microelectronic process arts such as, for example, glass, alumina, and quartz. An optional second metal layer 322 may be deposited on the face of the substrate opposite the first metal layer 320. In a preferred embodiment, the second metal layer 322 is held at or near the same voltage potential as the first metal layer 320.

In a preferred embodiment, electrodes 310, 315 are fabricated using deep reactive ion etching (DRIE) methods in the MEMS/semiconductor processing arts. In accordance with such methods, a metal layer 320 is first deposited on a first major surface of a continuous substrate 325. Optionally, a second metal layer 322 is then deposited on a second major surface of the substrate using photolithographic techniques. The metal layer(s) are then etched to separate electrodes 310, 315 and the substrate is etched through to define the gaps between the electrode fingers.

A voltage source 340 applies a voltage potential across the first and second electrodes, which creates an electric field in the volume 335 between the electrode fingers. The voltage is selected such that the electric field generated in volume 335 is sufficient to create an ionization region within volume 335 and ionize a portion of the molecules in the volume. The voltage source 340 may apply a DC voltage to create a corona discharge in volume 335 or may apply an RF voltage to generate a plasma in the volume.

Deflector electrode 360 may be disposed above and/or below the ionizer to drive ions from the volume 335 to another location for analysis. The "pass-through" design of ionizer 300 enables a gas to enter plenum volume 370, ionize a portion of the gas in ionizer 300, and have the ions removed to a second plenum volume 372 for downstream analysis. The "pass-through" design of ionizer 300 alternatively allows ions generated in ionizer 300 to be transported from the ionizer to the second plenum volume 372 by establishing a flow from the first plenum volume 370 to the second plenum volume 372.

Figure 4:
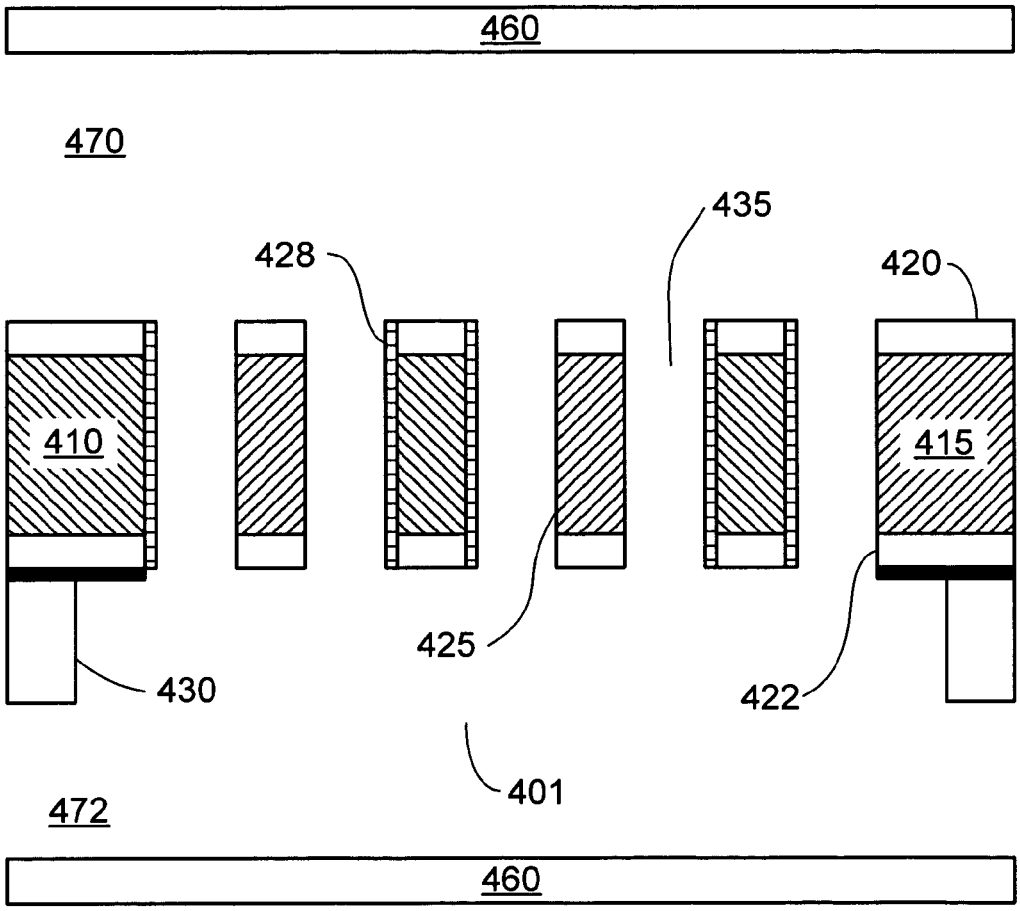
FIG. 4 is a side view of another embodiment of the present invention.

FIG. 4 is a side cross-sectional view of another embodiment of the present invention. In FIG. 4, structures similar to those shown in FIG. 3 are referenced with a corresponding reference number incremented by 100. FIG. 4 shows ionizer 401 attached to holding substrate 430. Ionizer 401 includes a first electrode 410 and a second electrode 415. Each electrode 410, 415 is preferably comb shaped, when seen from above, with the fingers of one electrode interdigitated with the fingers of the other electrode such that each finger of the first electrode is between fingers of the second electrode. The first and second electrodes are spaced apart such that the gaps between neighboring fingers define channels having a volume 435 where molecules may be ionized. The distance between neighboring fingers is preferably between 1-100 μm, more preferably between 5-60 μm, and most preferably between 10-40 μm.

Each electrode 410, 415 includes a metal layer 420 deposited on substrate 425. The metal layers 420 may be Pt, Au, Cr, Cu, Ni, or other suitable electrode materials that may be sputtered, chemical vapor deposited or electroplated onto the substrate. The substrate is preferably silicon but may also be selected from insulator materials known in the microelectronic process arts such as, for example, glass, alumina, and quartz. An optional second metal layer 422 may be deposited on the face of the substrate opposite the first metal layer 420. In a preferred embodiment, the second metal layer 422 is held at or near the same voltage potential as the first metal layer 420. In a preferred embodiment, electrodes 410, 415 are fabricated as described in conjunction with FIG. 3 using deep reactive ion etching (DRIE) methods in the MEMS/semiconductor processing arts.

A carbon nanotube layer 428 is disposed on the sides of the first electrode 410 facing the second electrode. In a preferred embodiment, the carbon nanotubes in layer 428 are oriented such that the axis of the carbon nanotube is generally parallel to the surface normal of the electrode side surface. The carbon nanotube layer may be fabricated in situ by biasing the electrodes and using plasma enhanced CVD methods such as those described in, for example, Chhowalla et al., "*Growth process conditions of vertically aligned carbon nanotubes using plasma enhanced chemical vapor deposition*," J. Appl. Phys., vol. 90, no. 10 (November 2001), which is incorporated herein by reference.

It is believed, without being limited to a particular theory, that the small radius of curvature at the ends of the carbon nanotubes creates a large electric field concentration such that ignition of a corona occurs at a lower applied potential across the first and second electrodes.

A voltage source (not shown) similar to voltage source 340 of FIG. 3 applies a voltage potential across the first and second electrodes, which creates an electric field in the volume 435 between the electrode fingers. The voltage is selected such that the electric field generated in volume 435 is sufficient to create an ionization region within volume 435 and ionize a portion of the molecules in the volume. The voltage source may apply a DC voltage to create a corona discharge in volume 435 or may apply an RF voltage to generate a plasma in the volume.

Deflector electrode 460 may be disposed above and/or below the ionizer to drive ions from the volume 435 to another location for analysis. The "pass-through" design of ionizer 401 enables a gas to enter plenum volume 470, ionize a portion of the gas in ionizer 401, and have the ions removed to a second plenum volume 472 for downstream analysis. The "pass-through" design of ionizer 401 alternatively allows ions generated in ionizer 401 to be transported from the ionizer to the second plenum volume 472 by establishing a flow from the first plenum volume 470 to the second plenum volume 472.

Figure 5:
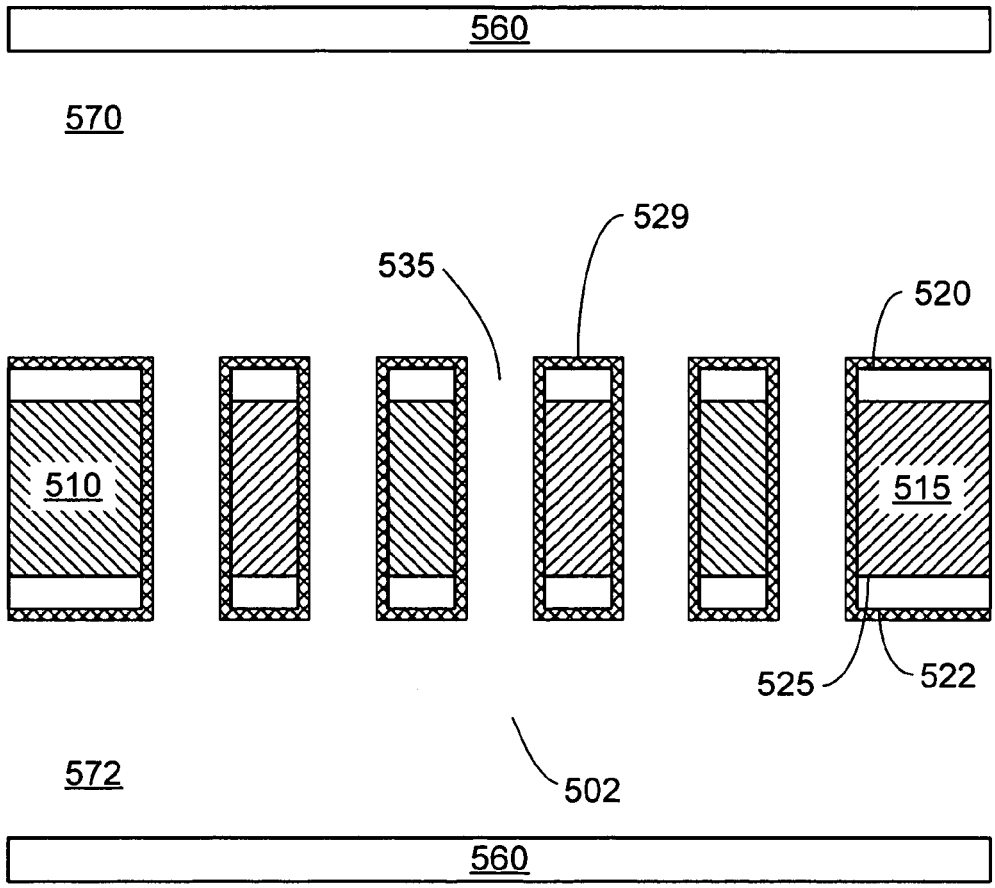
FIG. 5 is a side view of another embodiment of the present invention.

FIG. 5 is a side cross-sectional view of another embodiment of the present invention. In FIG. 5, structures similar to those shown in FIG. 3 are referenced with a corresponding reference number incremented by 200. Ionizer 502 includes a first electrode 510 and a second electrode 515. Each electrode 510, 515 is preferably comb shaped, when seen from above, with the fingers of one electrode interdigitated with the fingers of the other electrode such that each finger of the first electrode is between fingers of the second electrode. The first and second electrodes are spaced apart such that the gaps between neighboring fingers define channels having a volume 535 where molecules may be ionized. The distance between neighboring fingers is preferably between 1-100 μm, more preferably between 5-60 μm, and most preferably between 10-40 μm.

Each electrode 510, 515 includes a metal layer 520 deposited on substrate 525. The metal layers 520 may be Pt, Au, Cr, Cu, Ni, or other suitable electrode materials that may be sputtered, chemical vapor deposited or electroplated onto the substrate. The substrate is preferably silicon but may also be selected from insulator materials known in the microelectronic process arts such as, for example, glass, alumina, and quartz. An optional second metal layer 522 may be deposited on the face of the substrate opposite the first metal layer 520. In a preferred embodiment, the second metal layer 522 is held at or near the same voltage potential as the first metal layer 520. In a preferred embodiment, electrodes 510, 515 are fabricated as described in conjunction with FIG. 3 using DRIE methods in the MEMS/semiconductor processing arts.

A diamond-like coating (DLC) layer 529 covers the first and second electrodes 510, 515. In a preferred embodiment, the DLC layer is formed using filtered cathodic vacuum arc (FCVA) as described in Satyanarayana et al., "*Field emission from tetrahedral amorphous carbon*," Appl. Phys. Lett., vol 71, no. 10, (September 1997), which is incorporated herein by reference.

It is believed that, without being limited to a particular theory, the n-doped tetrahedral amorphous carbon (ta-C) in the DLC layer results in field emission of electrons at field strengths of about 10 V/μm. The chemical inertness and high hardness of the DLC layer is believed to contribute to improving the electrode lifetime.

A voltage source (not shown) similar to voltage source 340 of FIG. 3 applies a voltage potential across the first and second electrodes, which creates an electric field in the volume 535 between the electrode fingers. The voltage is selected such that the electric field generated in volume 535 is sufficient to create an ionization region within volume 535 and ionize a portion of the molecules in the volume. The voltage source may apply a DC voltage to create a corona discharge in volume 535 or may apply an RF voltage to generate a plasma in the volume.

Deflector electrode 560 may be disposed above and/or below the ionizer to drive ions from the volume 535 to another location for analysis. The "pass-through" design of ionizer 502 enables a gas to enter plenum volume 570, ionize a portion of the gas in ionizer 502, and have the ions removed to a second plenum volume 572 for downstream analysis. The "pass-through" design of ionizer 502 alternatively allows ions generated in ionizer 502 to be transported from the ionizer to the second plenum volume 572 by establishing a flow from the first plenum volume 570 to the second plenum volume 572.

Having thus described at least illustrative embodiments of the invention, various modifications, and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed:

1. An ionization source comprising:
a first electrode having a plurality of fingers;
a second electrode having a plurality of fingers, the plurality of fingers of the second electrode disposed between the plurality of fingers of the first electrode; and
a generator for applying a signal between the first and second electrodes, the signal generating an ionization volume between the first and second electrode; and
a diamond-like coating (DLC) layer deposited on the first and second electrodes wherein the DLC layer comprises n-doped tetrahedral amorphous carbon.

2. The ionization source of claim 1, wherein a distance between the first electrode and the second electrode is between 100 μm and 1 μm.

3. The ionization source of claim 2, wherein the distance between the first electrode and the second electrode is between 60 μm and 5 μm.

4. The ionization source of claim 3, wherein the distance between the first electrode and the second electrode is between 40 μm and 10 μm.

5. The ionization source of claim 1, further comprising a carbon nanotube layer disposed on a side of the first electrode facing a side of the second electrode.

6. The ionization source of claim 5, wherein the carbon nanotube layer comprises a plurality of carbon nanotubes characterized by a longitudinal axis, the longitudinal axis parallel to a surface normal of the side of the first electrode.

7. The ionization source of claim 1, wherein the DLC layer is deposited using a filtered cathodic vacuum arc (FCVA).

8. The ionization source of claim 1, wherein the gap between the first and second electrodes forms a channel that is serpentine in cross-section.

9. An ionization source comprising:
a first electrode having a plurality of fingers, said electrode appearing comb shaped when seen from above; and
a second electrode having a plurality of fingers, said electrode appearing comb shaped when seen from above, the fingers of the second electrode interdigitated with the fingers of the first electrode with a gap between the first and second electrodes that is serpentine in cross-section;
wherein the first and second comb-shaped electrodes are oriented in a flow stream so that they are transverse to the direction of flow of the stream.

10. The ionization source of claim 9, further comprising a deflector electrode disposed above and/or below the gap between the first and second electrodes to drive ions from between the electrodes to another location for analysis.

11. The ionization source of claim 9, further comprising a voltage source which applies a voltage potential across the first and second electrodes.

12. The ionization source of claim 9, further comprising a carbon nanotube layer disposed on a side of the first electrode facing a side of the second electrode.

13. The ionization source of claim 12, wherein the carbon nanotube layer comprises a plurality of carbon nanotubes characterized by a longitudinal axis, the longitudinal access parallel to a surface normal of the side of the first electrode.

14. An ionization source comprising:

a first electrode having a plurality of substantially parallel planar fingers interconnected at one end; and a second electrode having a plurality of substantially parallel planar fingers interconnected at one end, the fingers of the second electrode interdigitated with the fingers of the first electrode with a gap between the first and second electrodes;

wherein the first and second electrodes are oriented in a flow stream so that they are transverse to the direction of flow of the stream.

15. The ionization source of claim 14, further comprising a deflector electrode disposed above and/or below the first and second electrodes to drive ions from between the electrodes to another location for analysis.

16. The ionization source of claim 14, further comprising a voltage source which applies a voltage potential across the first and second electrodes.

17. The ionization source of claim 14, further comprising a carbon nanotube layer disposed on a side of the first electrode facing a side of the second electrode.

18. The ionization source of claim 17, wherein the carbon nanotube layer comprises a plurality of carbon nanotubes characterized by a longitudinal axis, the longitudinal access parallel to a surface normal of the side of the first electrode.

* * * * *